United States Patent [19]

Howell et al.

[11] 4,032,194

[45] June 28, 1977

[54] METHOD FOR THE PRODUCTION OF MINERALS

[75] Inventors: Eddie P. Howell; Orland J. Gant, Jr., both of Plano, Tex.

[73] Assignee: Atlantic Richfield Company, Los Angeles, Calif.

[22] Filed: Aug. 23, 1976

[21] Appl. No.: 716,495

[52] U.S. Cl. ..... 299/4; 423/15; 423/17

[51] Int. Cl.[2] ..... E21B 43/28

[58] Field of Search ..... 299/4; 423/15, 17

[56] References Cited

UNITED STATES PATENTS

| | | | |
|---|---|---|---|
| 3,309,140 | 3/1967 | Gardner et al. | 299/4 |
| 3,574,599 | 4/1971 | Ortloff et al. | 299/4 X |
| 3,860,289 | 1/1975 | Learmont | 299/4 |

*Primary Examiner*—Ernest R. Purser
*Assistant Examiner*—William F. Pate, III
*Attorney, Agent, or Firm*—Ronnie D. Wilson

[57] ABSTRACT

The present invention relates to an improved method for the solution mining of a mineral from a subterranean formation. More specifically, the invention relates to an improved method which enhances significantly the recovery of a mineral from a subterranean formation via solution mining utilizing an injection and production well. The improvement comprises positioning an injection well in the reduced zone and a production well in the oxidized zone of a formation.

7 Claims, No Drawings

METHOD FOR THE PRODUCTION OF MINERALS

Generally, known methods for solution mining of a mineral in situ utilize an acid or alkaline leach solution for the dissolution of the mineral. An oxidant is injected into the formation along with the leach solution. The mineral is leached from the formation and recovered from a production well via a pregnant leach solution. Various procedures for recovering the mineral from the pregnant leach solution are well known, such as ion exchange.

The method of the present invention is particularly suitable for the leaching of uranium; however, our invention is not so limited. The following description of the present invention will be applied to uranium leaching; however, it is apparent that it is applicable to leaching other mineral values such as copper, nickel, molybdenum, rhenium and selenium where similar problems are encountered.

Although acid leaching solutions can be used in some formations, only alkaline leaching solutions can be used where the particular formation contains significant quantities of acid-consuming gangue.

It is well-known that to recover uranium from an underground ore body, it is necessary to convert the relatively insoluble tetravalent state of uranium in the ore to the solubilizable hexavalent state. When using an alkaline leach solution, the dissolution of the uranium in solution occurs in two steps. The first step involves the oxidation of uranium by absorbing oxygen and the second is the dissolution of the oxidized uranium in the solution.

During the early stages (when the ore body is in a reduced state) of a leach operation utilizing alkaline solutions of ammonium carbonate, sodium carbonate, potassium carbonate and their respective bicarbonates in conjunction with the typical oxidants of air, oxygen, and hydrogen peroxide, the uranium that is oxidized and dissolved near the injection well is reduced and precipitated in the more reduced regions of the formation between the injection well and the production well. Through this action the oxidized region of the formation is depleted of uranium and the reduced region of the formation becomes enriched as the leach operation continues. Therefore, this process of oxidation and dissolution followed by reduction and precipitation continues as the formation becomes progressively oxidized, whereby the region in the immediate vicinity of the production well becomes progressively enriched. As a result, the uranium is depleted from a zone in the formation far more quickly than the oxidant consuming gangue species present therein. Therefore, as the uranium oxidation front recedes from the injection well, the available oxidant for oxidation of the uranium decreases. This causes a slower dissolution of uranium and a lower maximum concentration of uranium solution as the depleted zone moves through the formation. Therefore, there is needed a method whereby a formation containing a mineral such as uranium can be leached with a leach solution without being accompanied by excessive losses of oxidant and a diminishing rate of mineral recovery.

It has been found that many ore deposits are formed at a boundary where the oxidation potential changes from strongly oxidizing to strongly reducing. The ore is found on the reducing side of this boundary. By utilizing the difference in the natural oxidation potential across this boundary, a uniform oxidation potential can be applied to the ore facilitating mineral recovery without excessive losses of oxidant and quickly diminishing rate of recovery.

Therefore, it is an object of the present invention to provide an improved method for the solution mining of a mineral from a subterranean formation, applicable generally to minerals requiring oxidation to be leached and to both acid and alkaline leach solutions.

A further object of the present invention is to provide an improved method for the solution mining of uranium.

It is an additional objective of the present invention to provide an improved method for the solution mining of uranium from subterranean deposits which substantially maintains its initial rate of recovery in the later stages of the operation without the needless waste of oxidant.

Other objects, aspects, and the several advantages of the present invention will become apparent upon a further reading of this disclosure and the appended claims.

It has now been found that the objects of the present invention can be attained in a method for the solution mining of a mineral from a subterranean formation containing same in which an injection and production well are drilled and completed within said formation, a leach solution and an oxidant are injected through the injection well into the formation to dissolve the mineral and recover it via a production well, by positioning the injection well in the reduced zone and the production well in the oxidized zone of the formation.

In the operation of the improved method to recover uranium, the correct positioning of the wells requires the identification of the oxidation potential boundary. Utilizing boreholes drilled to the ore depth, the boundary is identified by (1) measuring oxidation potential at ore depth or (2) identifying reduced minerals (such as pyrite) or oxidized minerals (such as limonite) from cores or drill cuttings or (3) measuring oxidation potential in formation water samples. Thus, the boundary is located and the injection and production wells positioned on opposite sides of same. The injection well is positioned on the reduced side and the production well on the oxidized side. By injecting leach solution into the reduced zone and producing from the oxidized zone, the problems of reprecipitation are overcome by the elimination of the tendency to reduce the dissolved uranium and reprecipitate same in an oxidized zone.

By utilizing the natural zones in a formation, it is not necessary to subject the area around an injection well to an extremely high potential in an attempt to maintain a potential near a production well high enough to prevent reprecipitation of dissolved uranium. This positioning of the wells also allows for the use of lower oxidation potential leach solution and therefore resulting in less oxidation and solution of undesired contaminants. For example, if uranium were the desired mineral, the oxidation potential of the leach solution could be limited to a value low enough to still dissolve uranium but not some of the minerals that are soluble at higher oxidation potentials.

Therefore, the utilization of the present invention in the recovery of uranium via in situ leaching processes, can be enhanced significantly by most effectively using the natural oxidation potential boundary present in the formation.

Often the concentration of uranium in a formation is not significant compared with other minerals that will also be oxidized in a process that oxidizes uranium to render it soluble in a leaching solution. Pyrite ($FeS_2$) is often found in uranium bearing formations. If the concentration of pyrite in a formation is 2% and the rock density is about 120 lb/ft$^3$, the concentration of $FeS_2$ is $\approx$ 2.4 lb/ft$^3$ or Fe $\approx$ 1.1 lb/ft$^3$. The amount of oxygen utilized to produce an iron oxide ($Fe_2O_3$) is $\approx$0.5 lb/ft$^3$. Utilizing the present invention, only about one-half the number of cubic feet of formation would have to be oxidized than that required to be oxidized without the present invention to solubilize a given amount of uranium, thereby significantly reducing the amount of oxidant required to solubilize uranium.

In addition, in regard to uranium, the present invention provides a more uniform contact between uranium and leaching solution. Typically, oxidant is consumed in a formation at a rate greater than it is supplied, resulting in the reprecipitation of uranium and other minerals. A continuous process of solution and reprecipitation occurs as the uranium moves toward a production well. This reprecipitation of uranium and other minerals can result in isolation of various uranium bearing zones between injection and production wells due to local reduction of permeability.

Having thus described our invention, we claim:

1. An improved method for the solution mining of a mineral from a subterranean formation containing same in which an injection and production well are drilled and completed within said formation, leach solution and an oxidant are injected through said injection well into said formation to dissolve said mineral, and said dissolved mineral is recovered via said production well, wherein the improvement comprises positioning said injection well in the reduced zone and said production well in the oxidized zone of said formation.

2. The improvement of claim 1 wherein said mineral is selected from the group consisting of copper, nickel, molybdenum, rhenium, selenium and uranium.

3. The improvement of claim 1 wherein said leach solution is acidic in nature.

4. The improvement of claim 3 wherein said acid leach solution is selected from the group consisting of hydrochloric and sulfuric acid.

5. The improvment of claim 1 wherein said leach solution is alkaline in nature.

6. The improvement of claim 5 wherein said alkaline leach solution is an aqueous solution of one or more salts selected from the group consisting of ammonium carbonate, sodium carbonate, potassium carbonate and their respective bicarbonates.

7. The improvement of claim 1 wherein said oxidant is selected from the group consisting of air, oxygen and hydrogen peroxide.

* * * * *